US007298086B2

(12) United States Patent
Shinohe et al.

(10) Patent No.: US 7,298,086 B2
(45) Date of Patent: Nov. 20, 2007

(54) PLASMA TUBE ARRAY

(75) Inventors: Koji Shinohe, Kawasaki (JP); Manabu Ishimoto, Kawasaki (JP); Kenji Awamoto, Kawasaki (JP); Hitoshi Yamada, Kawasaki (JP); Akira Tokai, Kawasaki (JP); Yosuke Yamazaki, Kawasaki (JP); Hitoshi Hirakawa, Kawasaki (JP)

(73) Assignee: Shinoda Plasma Corporation, Akashi-Shi (JP)

( * ) Notice: Subject to any disclaimer, the term of this patent is extended or adjusted under 35 U.S.C. 154(b) by 253 days.

(21) Appl. No.: 11/216,104

(22) Filed: Sep. 1, 2005

(65) Prior Publication Data

US 2006/0244378 A1 Nov. 2, 2006

(30) Foreign Application Priority Data

Apr. 28, 2005 (JP) ..... 2005-131487

(51) Int. Cl.
*H01J 17/49* (2006.01)

(52) U.S. Cl. ..... 313/582; 313/584

(58) Field of Classification Search ..... 313/491, 313/582–587, 594

See application file for complete search history.

(56) References Cited

U.S. PATENT DOCUMENTS

| | | | | |
|---|---|---|---|---|
| 2003/0048068 | A1* | 3/2003 | Yamada et al. | 313/485 |
| 2003/0122485 | A1* | 7/2003 | Tokai et al. | 313/582 |
| 2003/0184212 | A1* | 10/2003 | Ishimoto et al. | 313/491 |

FOREIGN PATENT DOCUMENTS

| | | |
|---|---|---|
| JP | 61-103187 | 5/1986 |
| JP | 2003-086141 | 3/2003 |
| JP | 2003-092085 | 3/2003 |
| JP | 2003-338244 | 11/2003 |

* cited by examiner

*Primary Examiner*—Vip Patel
(74) *Attorney, Agent, or Firm*—Staas & Halsey LLP

(57) ABSTRACT

The present invention provides a plasma tube array including: plural light-emitting tubes; a front supporting member and a back supporting member which spread over the front and back of the light-emitting tubes; plural display electrode pairs provided on the surface of the front supporting member facing the light-emitting tubes; and plural signal electrodes provided on the surface of the back supporting member facing the light-emitting tubes. Each display electrode constituting the display electrode pair is a display electrode which is made of a metal thin wire, provided with plural openings formed in a distributed manner and includes a first metal thin wire facing a discharge slit and extending along the discharge slit, and the first metal thin wire is a metal thin wire thicker than a second metal thin wire which forms a region closer to a non-discharge slit side than the first metal thin wire.

18 Claims, 13 Drawing Sheets

PLASMA TUBE ARRAY

BACKGROUND OF THE INVENTION

1. Field of the Invention

The present invention relates to a plasma tube array which includes an array of two or more light-emitting tubes incorporating fluorescent substance layers therein, produces discharge inside the two or more light-emitting tubes and causes the fluorescent substance layers inside the light-emitting tubes to emit light and thereby displays an image.

2. Description of the Related Art

As a large image display device which performs self light emission, there is a proposal on a technique (see Japanese Patent Laid-Open No. 61-103187) of displaying an image by using the principle of plasma display with an array of multiple light-emitting strings made up of glass tubes incorporating fluorescent substance layers therein and controlling light emission by parts of the respective light-emitting strings (see Japanese Patent Laid-Open No. 61-103187).

Each light-emitting string includes a protective film such as an MgO film and a fluorescent substance layer in the glass tube filled with a discharge gas composed of, for example, Ne and Xe. The fluorescent substance layer is formed on a supporting member, a mounted part, called a "boat", which has a substantially semicircular cross-section and the supporting member (boat) is inserted into the glass tube. Then, the glass tube is heated in a vacuum chamber and the gas is exhausted, the tube is filled with a discharge gas and then both ends of the glass tube are sealed. Multiple light-emitting strings created in this way are arranged in parallel and fixed and the light-emitting strings are provided with electrodes and a voltage is applied to the electrodes to thereby provoke discharge in the light-emitting strings and cause the fluorescent substance to emit light.

FIG. 1 is a perspective view showing a basic structure of a plasma tube array.

The plasma tube array (PTA) 100 shown here has a structure in which light-emitting strings 10R, 10G, 10B, 10R, 10G, 10B, . . . containing fluorescent substance layers which emit red (R), green (G), blue (B) fluorescence filled with a discharge gas are arranged in parallel and in a planar shape as a whole, and a transparent front supporting member 20 and a transparent back supporting member 30 are placed on the front and back of the light-emitting strings 10R, 10G, 10B, 10R, 10G, 10B, . . . respectively and the array of multiple light-emitting strings 10R, 10G, 10B, 10R, 10G, 10B, . . . are held between the front supporting member 20 and back supporting member 30.

On the front supporting member 20 are multiple display electrode pairs 21 each made up of two display electrodes 211, 212 arranged parallel to each other forming a discharge slit in between in the direction of the array of the multiple light-emitting strings 10R, 10G, 10B, 10R, 10G, 10B, . . . that is, the direction in which the display electrodes extend across the multiple light-emitting strings 10R, 10G, 10B, 10R, 10G, 10B, . . . . These display electrode pairs 21 are arranged in two or more rows in the longitudinal direction of the light-emitting strings 10R, 10G, 10B, 10R, 10G, 10B, . . . forming a non-discharge slit between the neighboring display electrode pairs 21. Furthermore, the two display electrodes 211, 212 making up one display electrode pair 21 consist of metallic (e.g., Cr/Cu/Cr) bus electrodes 211*a*, 212*a* on the mutually far sides (non-discharge slit sides) and transparent electrodes 211*b*, 212*b* each made up of an ITO thin film on the mutually near sides (discharge slit sides). The bus electrodes 211*a*, 212*a* are intended to reduce the electric resistance of the display electrodes 211, 212 and the transparent electrodes 211*b*, 212*b* are designed so as to allow light emitted from the light-emitting strings 10R, 10G, 10B, 10R, 10G, 10B, . . . to pass through up to the front supporting member 20 side without being intercepted and thereby realize brighter display.

Furthermore, on the back supporting member 30 are multiple metallic signal electrodes 31 which are associated with and extend parallel to the multiple light-emitting strings 10R, 10G, 10B, 10R, 10G, 10B, . . . respectively.

When the PTA 100 having such a structure is viewed two-dimensionally, the intersections between the signal electrodes 31 and display electrode pairs 21 become unit light-emitting regions (unit discharge regions). Display is realized by using either one of the display electrode 211, 212 as a scanning electrode, producing a selective discharge at the intersection between the scanning electrode and signal electrode 31 to select a light-emitting region, using wall charge formed on the inner surface of the light-emitting string of the region accompanying the discharge and thereby generating a display discharge between the display electrodes 211, 212. A selective discharge is an opposed discharge produced in the light-emitting string between the opposed scanning electrode and signal electrode 31 in vertical direction, while a display discharge is a planar discharge produced in the light-emitting string between the display electrodes 211, 212 arranged in parallel on a plane. Such an electrode arrangement causes two or more light-emitting regions to be formed inside the light-emitting string in the longitudinal direction.

FIG. 2 is a schematic view showing the structure of light-emitting strings making up the PTA 100 shown in FIG. 1.

Here, three light-emitting strings 10R, 10G, 10B are shown. Each of the light-emitting strings 10R, 10G, 10B has a structure in which a protective film 12 of MgO, etc., is formed on the inner surface of a glass tube 11 and a boat 13 which is a supporting member on which fluorescent substance layer 14R, 14G, 14B emitting R, G, B fluorescence is formed is inserted in the glass tube 11 (see Japanese Patent Laid-Open No. 2003-86141).

FIG. 3 shows the boat on which the fluorescent substance layer is formed.

The boat 13 has a semicircular or U-figured cross-section or the like and has an elongated shape as with the glass tube 11 (see FIG. 2) and each of three types of fluorescent substance layers 14R, 14G, 14B (see FIG. 2: here represented by the fluorescent substance layer 14) corresponding to the three type of light-emitting strings 10R, 10G, 10B shown in FIG. 1, FIG. 2 is formed on the inside thereof.

Returning to FIG. 2, the explanation will be continued.

Each of the light-emitting strings 10R, 10G, 10B shown in FIG. 2 has a structure in which the boat 13 having the shape shown in FIG. 3 is inserted in the glass tube 11. FIG. 2 shows the display electrode pair 21 made up of the two display electrodes 211, 212, between which a discharge slit is formed, is arranged on the light-emitting strings 10R, 10G, 10B. The two display electrodes 211, 212 are made up of metallic bus electrodes 211*a*, 212*a* and transparent electrodes 211*b*, 212*b*.

Here, in the case of the structure shown in FIG. 2, a region D1 defined by one set of the three light-emitting strings 10R, 10G, 10B provided with the three types of fluorescent substance layers 14R, 14G, 14B respectively and one display electrode pair 21 made up of the two display electrodes 211, 212 constitutes one pixel which is a unit for displaying a color image. The diameter of each light-emitting string 10R, 10G, 10B is typically on the order of 1 mm, and therefore in the case of the structure shown in this FIG. 2, the size of the region D1 of one pixel is about 3 mm×3 mm.

In the PTA having the basic structure described above, instead of arranging light-emitting strings two-dimensionally, it is also possible to form a curved image display plane by arranging the light-emitting strings along a curve (see Japanese Patent Laid-Open No. 2003-92085) or make the image display plane flexibly modifiable into various types of curved surfaces.

In such a case, a flexible substrate, for example, PET (polyethylene terephthalate) substrate is used as the front supporting member 20 and back supporting member 30 and the display electrodes 211, 212 formed on the front supporting member 20 are also required to have a structure resistant to bending. In this case, when the display electrodes 211, 212 combining the metallic bus electrodes 211*a*, 212*a* and transparent electrodes 211*b*, 212*b* each made up of an ITO thin film as explained with reference to FIG. 1, FIG. 2 are used, since the ITO thin film has poor ductility, it may be cracked or subject to breaks when the flexible substrate is bent. For this reason, instead of the transparent electrodes 211*b*, 212*b* made of the ITO thin film, there is a proposal on an electrode structure with metal thin wires wired in a mesh, ladder stitch, or comb-like pattern (Japanese Patent Laid-Open No. 2003-338244). The electrodes having wiring of these metal thin wires are more appropriate in the sense that they are resistant to bending of the substrate and that the image display plane is formed on a flexible curved surface.

FIG. 4 is a schematic diagram showing an example of display electrodes using metal thin wires.

The figure shows a display electrode pair 21 made up of two display electrodes 211, 212 with a discharge slit 210 formed in between and the respective display electrodes 211, 212 are made up of bus electrodes 211*a*, 212*a* which are also provided for the display electrodes shown in FIG. 1, FIG. 2 and branched electrodes 211*c*, 212*c* made up of mesh-like metal thin wires 611, 612 instead of the transparent electrodes 211*b*, 212*b* shown in FIG. 1, FIG. 2. In these branched electrodes 211*c*, 212*c*, multiple openings 621, 622 surrounded by the metal thin wires 611, 612 are formed, distributed over all the branched electrodes 211*c*, 212*c*.

When the display electrodes 211, 212 having the structure shown in FIG. 4 as well as the display electrodes using the transparent electrodes 211*b*, 212*b* shown in FIG. 1, FIG. 2, a discharge produced in the discharge slit 210 provokes a discharge inside the light-emitting string 10 (called light-emitting string 10 as representative of light-emitting strings 10R, 10G, 10B) shown in FIG. 2 and causes the fluorescent substance 14 therein to emit light.

Light emitted from this fluorescent substance passes through the discharge slit 210 or the openings 621, 622 of the branched electrodes 211*c*, 212*c* and appears as an image when the entire display surface is viewed.

SUMMARY OF THE INVENTION

The problem to be solved when using the display electrodes having a structure with wiring of metal thin wires as illustrated in FIG. 4 is to make compatible reducing the resistance of the display electrodes and allowing light emitted from the fluorescent substance to pass through the structure with a high degree of efficiency.

Wiring relatively wide (or thick) metal thin wires or wiring metal thin wires relatively densely can reduce the electric resistance of the display electrodes but this causes the ratio of the area of the openings 621, 622 to the total area of the branched electrodes 211*c*, 212*c* (hereinafter referred to as "opening ratio") to decrease, which causes the light emitted form the fluorescent substance to be shielded, reducing the transmission coefficient and resulting in a dark image.

On the contrary, using thinner metal thin wires and using more coarse wiring of metal thin wires will increase the opening ratio and improve the transmission coefficient accordingly, but the electric resistance of the display electrodes 211, 212 is also increased, which requires a higher drive voltage to be applied to the display electrodes to obtain necessary light-emission intensity, etc., leading to deterioration of the discharge characteristic.

The present invention has been made in view of the above circumstances and provides a plasma tube array including display electrodes adopting more flexible wiring of metal thin wires and having an electrode structure which makes both a discharge characteristic and a high opening ratio compatible at a high level.

A plasma tube array according to the present invention includes:

a plurality of light-emitting tubes arranged parallel to one another, each containing a fluorescent substance layer;

a front supporting member and a back supporting member which spread over the front and back of the plurality of light-emitting tubes;

a plurality of display electrode pairs provided on the surface of the front supporting member facing the light-emitting tubes, each made up of two display electrodes extending parallel to each other in a direction extending across the plurality of light-emitting tubes between which a predetermined discharge slit is interposed, with one display electrode pair neighboring the other with a non-discharge slit interposed in between; and a plurality of signal electrodes provided on the surface of the back supporting member facing the light-emitting tubes, formed associated with the plurality of light-emitting tubes, which extend along the light-emitting tubes, wherein at least one of the display electrodes constituting the display electrode pair has a plurality of openings and metal wires forming the openings have different widths depending on area.

In the plasma tube array according to the present invention, preferably, at least one of the display electrodes constituting the display electrode pair has a metal wire facing the discharge slit and extending along the discharge slit, the metal wire being larger in width than other metal wires.

In the plasma tube array according to the present invention, preferably, at least one of the display electrodes constituting the display electrode pair has a plurality of metal wires extending in a direction orthogonal to the light-emitting tubes, and the metal wires are substantially parallel to the other of the display electrodes constituting the pair.

In the plasma tube array according to the present invention, preferably, among the metal wires, a metal wire having the largest width is twice in width than a metal wire having the smallest width.

In the plasma tube array according to the present invention, preferably, at least one of the display electrodes constituting the display electrode pair has a first region facing the discharge slit, the first region having a smaller opening ratio than a second region disposed closer to the non-discharge slit than the first region.

In the plasma tube array according to the present invention, preferably, the opening ratio of the first region is 50% or less.

In the plasma tube array according to the present invention, preferably, at least one of the display electrodes constituting the display electrode pair has a plurality of metal wires extending in a direction orthogonal to the light-emitting tubes and forming openings.

In the plasma tube array according to the present invention, preferably, at least one of the display electrodes constituting the display electrode pair has a metal wire facing the non-discharge slit and extending along the non-discharge slit, the metal wire being larger in width than other metal wires.

In the plasma tube array according to the present invention, preferably, at least one of the display electrodes constituting the display electrode pair includes an opening adjacent to the non-discharge slit, which is open to the non-discharge slit.

In the plasma tube array according to the present invention, preferably, the display electrodes constituting the display electrode pair excluding extension lines thereof are shaped symmetrically.

According to the present invention, it is possible to provide a plasma tube array including display electrodes having an electrode structure which makes both a discharge characteristic and a high opening ratio compatible at a high level, capable of forming a curved image display screen and bending the image display screen flexibly.

DETAILED DESCRIPTION OF THE INVENTION

Embodiments of the present invention will be described below.

Various embodiments which will be described below differ from the conventional techniques explained so far only in the electrode structure of the display electrode, and therefore the overall structure in the respective embodiments will be explained with reference to the explanations given so far and the electrode structure of the display electrode specific to the respective embodiments will be mainly described here.

Figure 5:
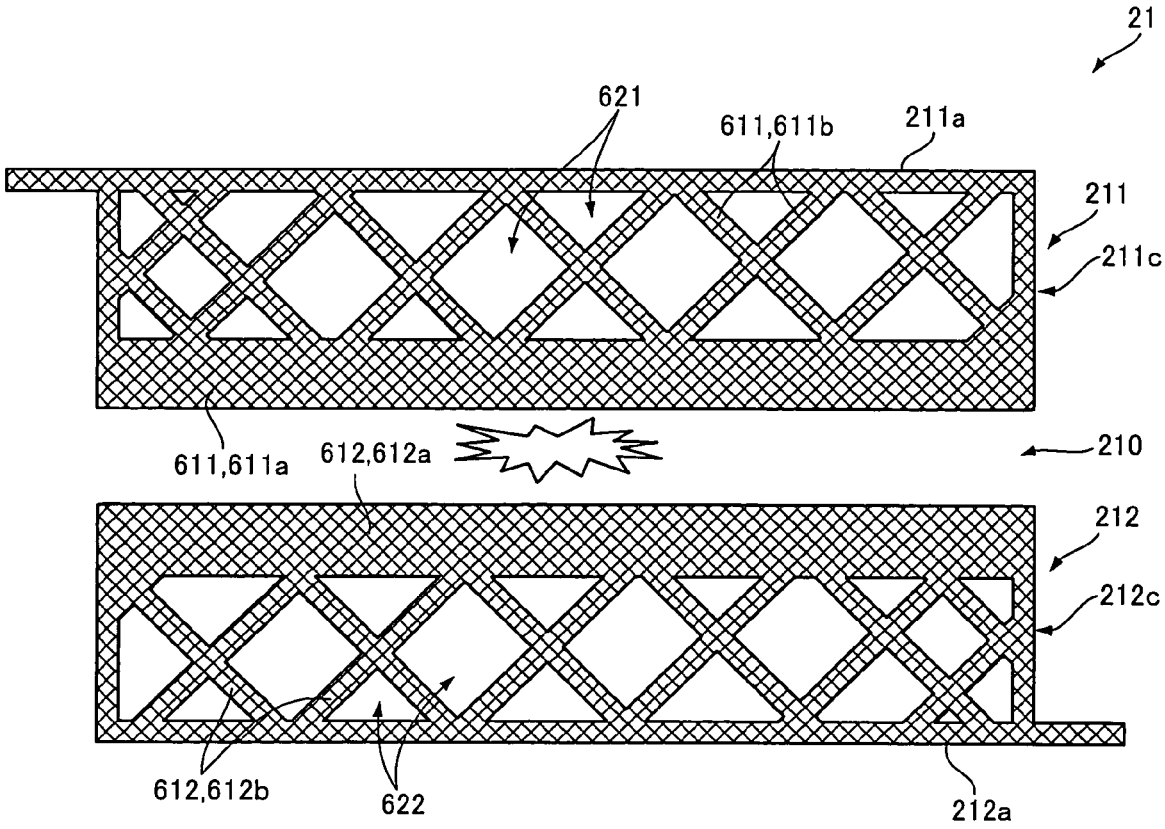
FIG. 5 illustrates display electrodes of a plasma tube array according to a first embodiment of the present invention.

FIG. 5 illustrates display electrodes of a plasma tube array according to a first embodiment of the present invention.

Figure 1:
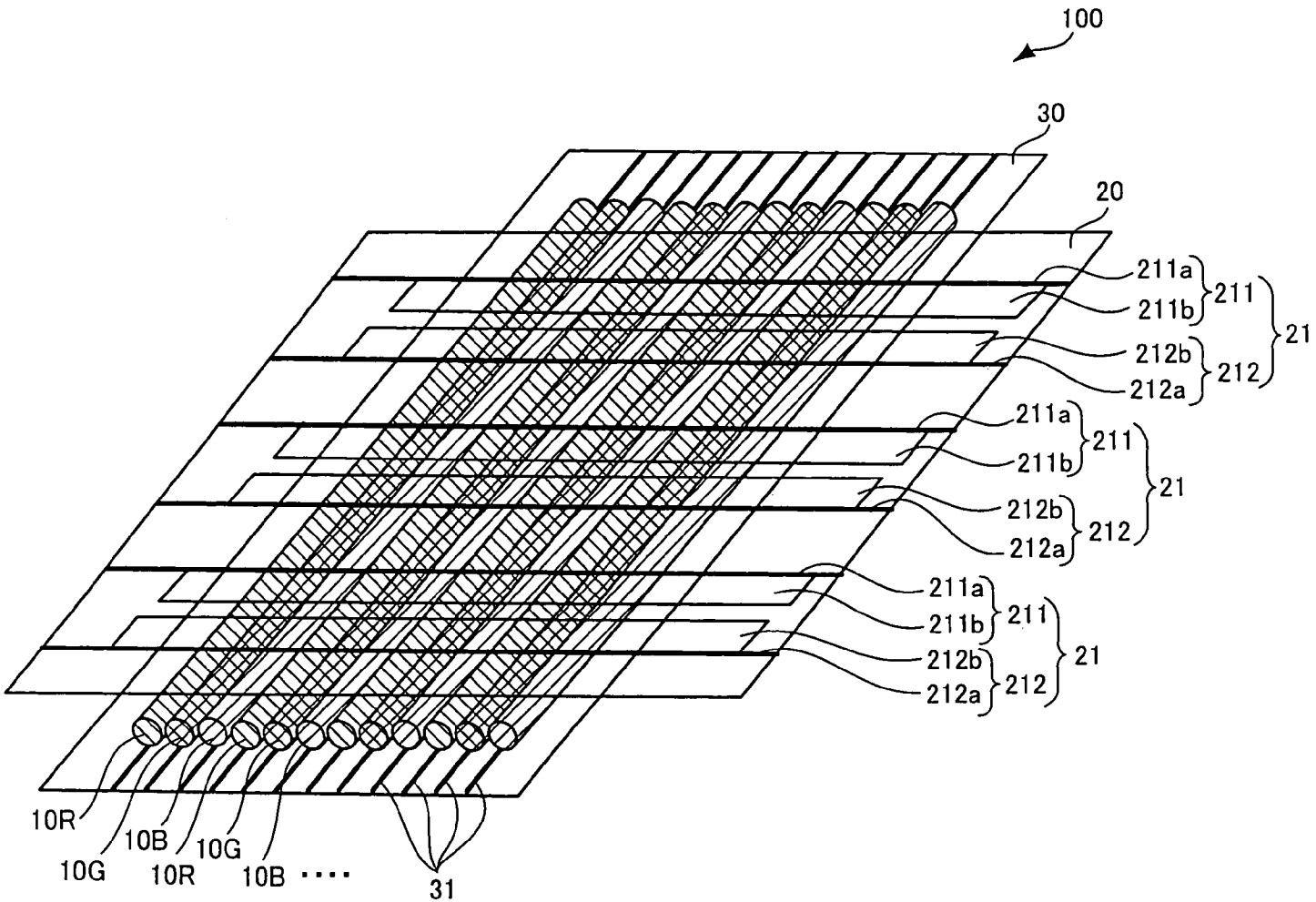
FIG. 1 is a perspective view showing a basic structure of a plasma tube array.
Figure 2:
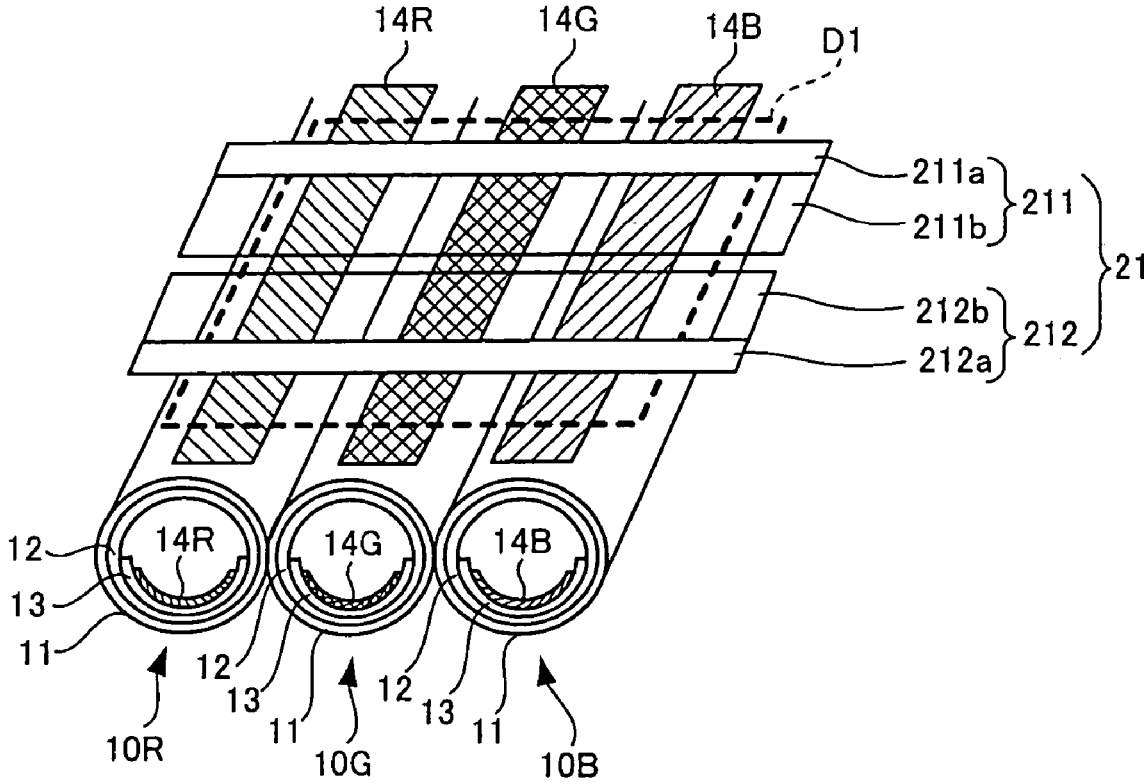
FIG. 2 is a schematic view showing a structure of a light-emitting string making up a plasma tube array.
Figure 3:
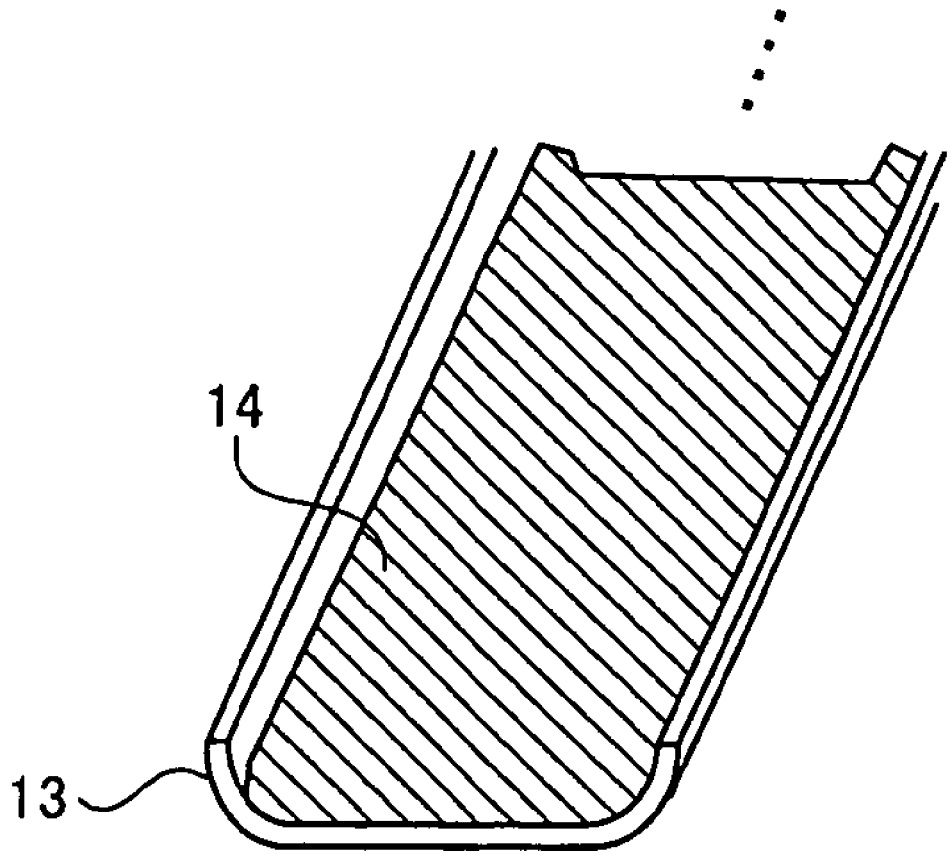
FIG. 3 illustrates a boat in which a fluorescent substance layer is formed.
Figure 4:
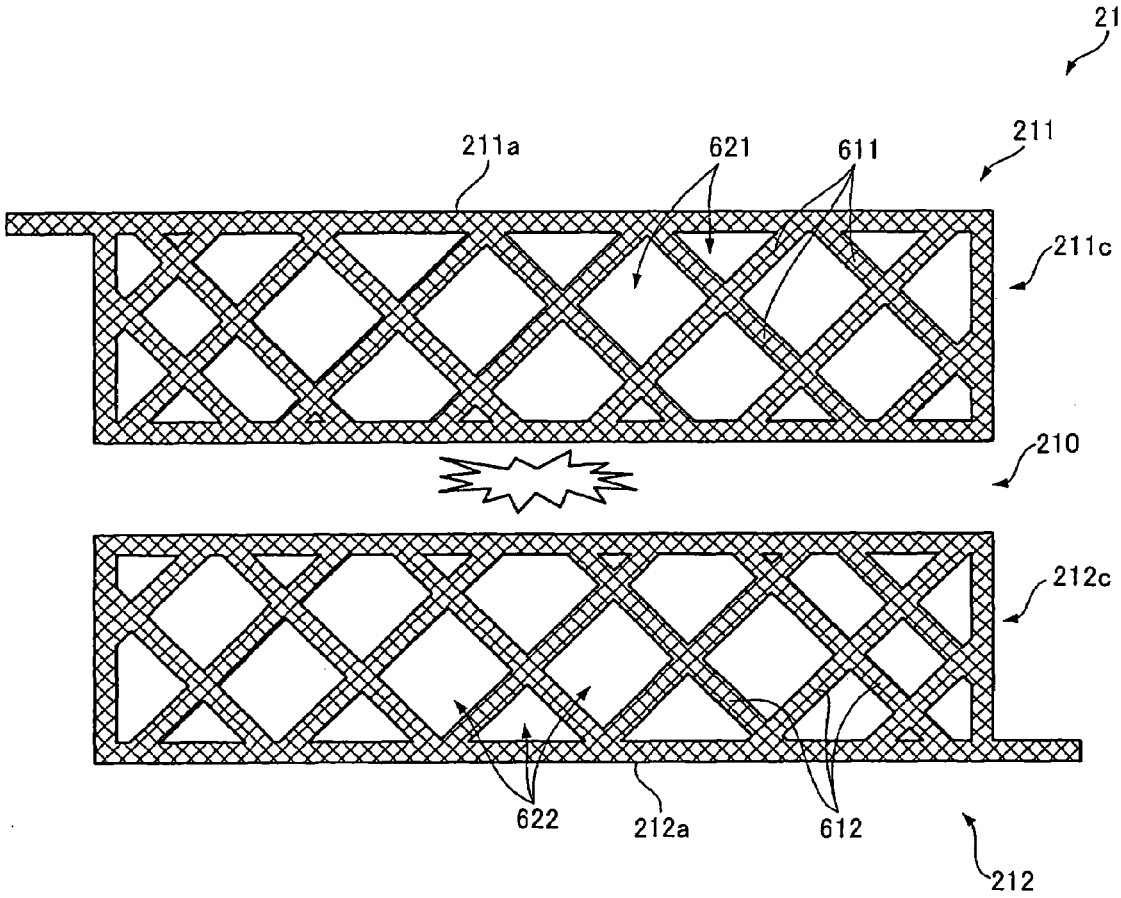
FIG. 4 is a schematic diagram showing an example of display electrodes adopting metal thin wires.

This figure shows a display electrode pair 21 made up of two display electrodes 211, 212 between which a discharge slit 210 is formed and the respective display electrodes 211, 212 are constructed of bus electrodes 211*a*, 212*a* and branched electrodes 211*c*, 212*c* made up of mesh-like metal thin wires 611, 612 as in the case of the conventional example shown in FIG. 4. Multiple openings 621, 622 surrounded by the metal thin wires 611, 612 are formed over the entire surfaces of the branched electrodes 211*c*, 212*c*.

What has been explained so far about the display electrodes shown in FIG. 5 are similar to the display electrodes in the conventional example shown in FIG. 4, but unlike the conventional example shown in FIG. 4, the display electrodes 211, 212 shown in FIG. 5 adopts metal thin wires having a greater width, as metal thin wires 611*a*, 612*a* facing the discharge slit 210 and extending the discharge slit, than metal thin wires 611*b*, 612*b* forming regions close to the non-discharge slit sides formed in a space with the neighboring display electrode pair. For example, the metal thin wires 611*a*, 612*a* are metal thin wires having a wire width of 20 μm and the metal thin wires 611*b*, 612*b* are metal thin wires having a wire width of 5 μm.

As shown in this FIG. 5, when thicker metal thin wires are used only for the parts facing the discharge slit 210, the discharge characteristic is improved a great deal. In this case, the overall opening ratio of the branched electrodes 211*c*, 212*c* decreases slightly, but it is possible to maintain a sufficiently high opening ratio.

Figure 6:
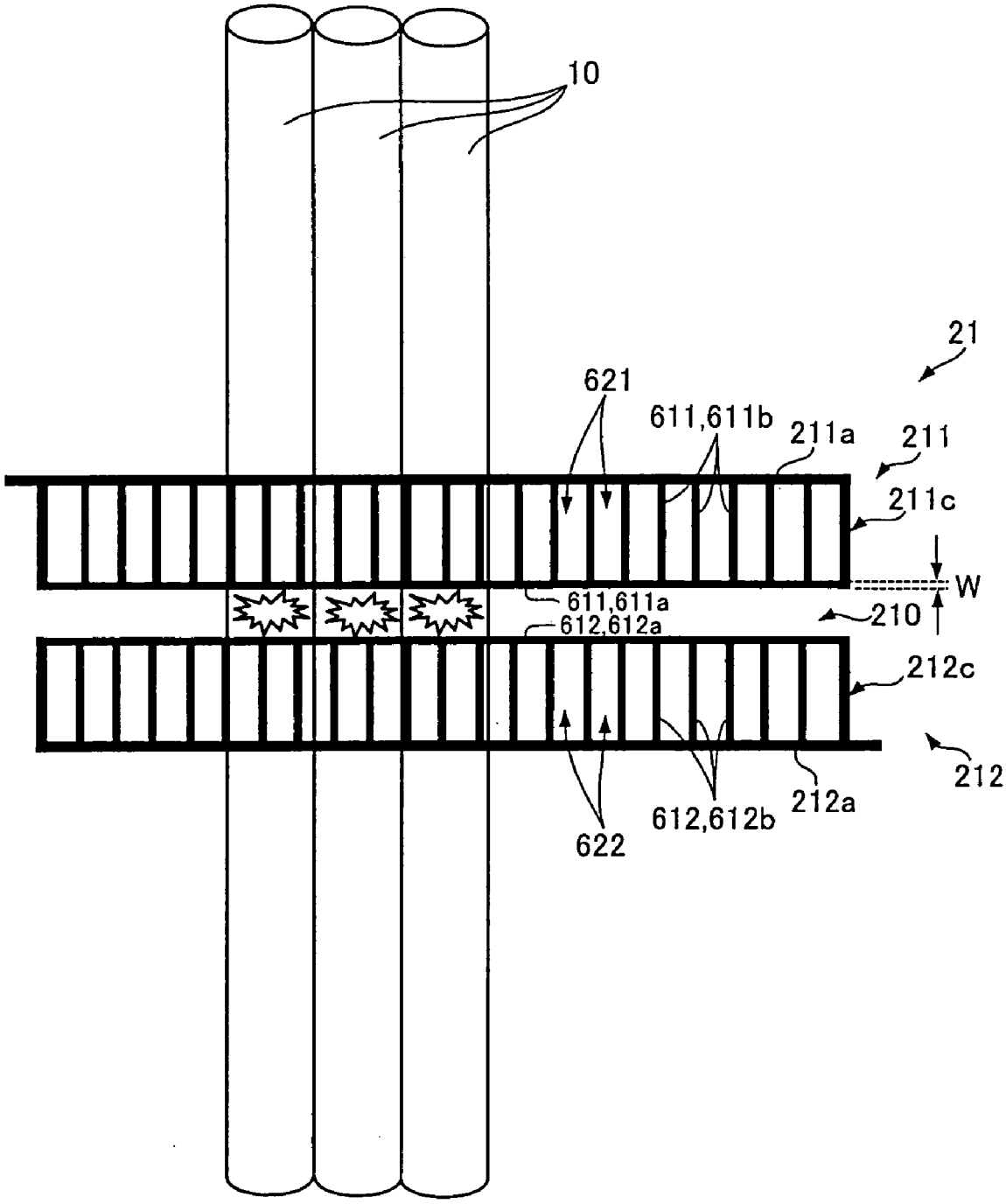
FIG. 6 illustrates display electrodes of a plasma tube array according to a second embodiment of the present invention.

FIG. 6 illustrates display electrodes of a plasma tube array according to a second embodiment of the present invention.

FIG. 6 shows three light-emitting strings 10. In this FIG. 6, the same components as those of the display electrodes of the first embodiment shown in FIG. 5 are assigned the same reference numerals as those in FIG. 5.

FIG. 6 as well as FIG. 5 shows a display electrode pair 21 made up of two display electrodes 211, 212 between which a discharge slit 210 is interposed. As in the case of the display electrodes shown in FIG. 5, the respective display electrodes 211, 212 are constructed of bus electrodes 211*a*, 212*a* and branched electrodes 211*c*, 212*c*. However, unlike FIG. 5, the branched electrodes 211*c*, 212*c* making up the display electrodes 211, 212 shown in this FIG. 6 have an electrode structure with ladder-like wiring of metal thin wires 611, 612.

An experiment is conducted here by creating the display electrodes 211, 212 using a wire width W of 12 μm and 20 μm as metal thin wires 611*a*, 612*a* facing the discharge slit 210 and extending along the discharge slit 210. The wire width of metal thin wires 611*b*, 612*b* other than the metal thin wires 611*a*, 612*a* facing the discharge slit 210 out of the metal thin wires 611, 612 making up the branched electrodes 211*c*, 212*c* is 5 μm.

Figure 7:
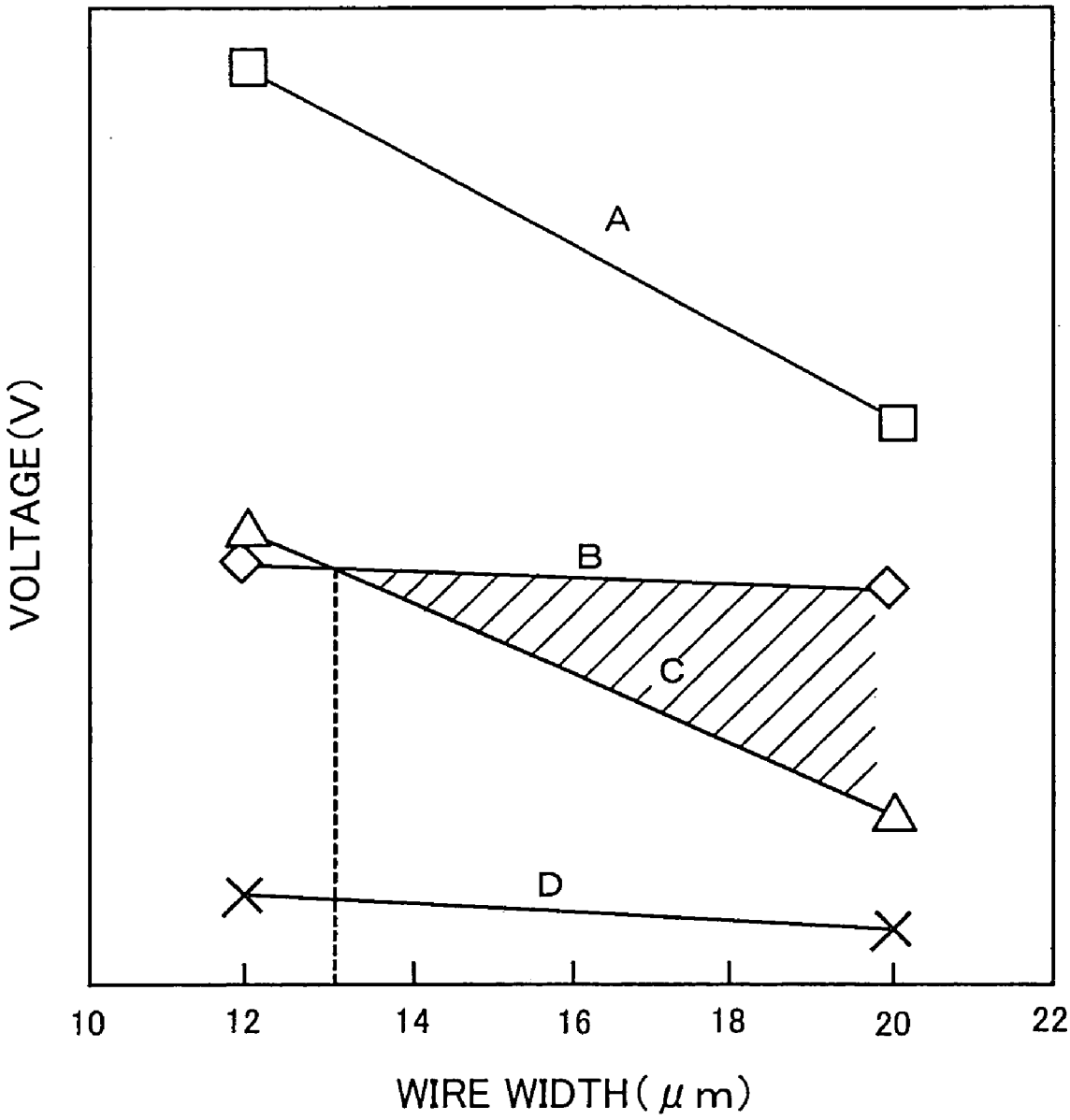
FIG. 7 illustrates an experiment result.

FIG. 7 illustrates the experiment result.

This FIG. 7 shows the result of continuously applying a high-voltage square wave voltage to the display electrodes 211, 212, so-called sustained drive, and graphs A, B, C, D show a last ON voltage, first ON voltage, first OFF voltage and last OFF voltage, respectively.

Here, the voltage at which at least one of pixels originally controlled so as not to emit light discharges (emits light)

when the voltage applied to the display electrodes 211, 212 is increased gradually from a sufficiently low voltage is the first ON voltage B and the voltage at which all pixels including even pixels originally controlled so as not to emit light discharge (emit light) is the last ON voltage A. Furthermore, the voltage at which at least one of pixels which should originally emit light stops emitting light when the voltage is increased gradually from a state in which all pixels originally controlled so as to emit light are discharging (emitting light) is the first OFF voltage C and the voltage at which all pixels which should originally emit light stop emitting light when the voltage is further decreased is the last OFF voltage D.

Therefore, it is necessary to drive the display electrodes at a voltage not higher than the first ON voltage B and not lower than the first OFF voltage C (region with hatching in FIG. 7) and this region between the first ON voltage B and first OFF voltage C corresponds to an operation allowance.

In the case of the display electrodes 211, 212 shown in FIG. 6, the first ON voltage B exceeds the first OFF voltage C when the wire width W of the metal thin wires 611*a*, 612*a* facing the discharge slit 210 is approximately 13 μm or above. The wire width at the intersection between the first ON voltage B and the first OFF voltage C varies depending on the electrode structure, etc., but the wire width of the metal thin wires 611*a*, 612*a* facing the discharge slit 210 needs to be 13 μm or above when the electrode structure shown in FIG. 6 is adopted.

As shown in this FIG. 7, it is possible to change the discharge characteristic drastically by only adjusting the wire width of the metal thin wires 611*a*, 612*a* facing the discharge slit 210 and secure a sufficient operation allowance and realize a stable discharge (light emission, image display) using the metal thin wires 611*a*, 612*a* having a relatively large wire width. Furthermore, since the discharge characteristic can be improved by only adjusting the wire width of the metal thin wires 611*a*, 612*a* facing the discharge slit 210, it is possible to secure a sufficient opening ratio, maintain a high transmission coefficient and provide bright display.

Figure 8:
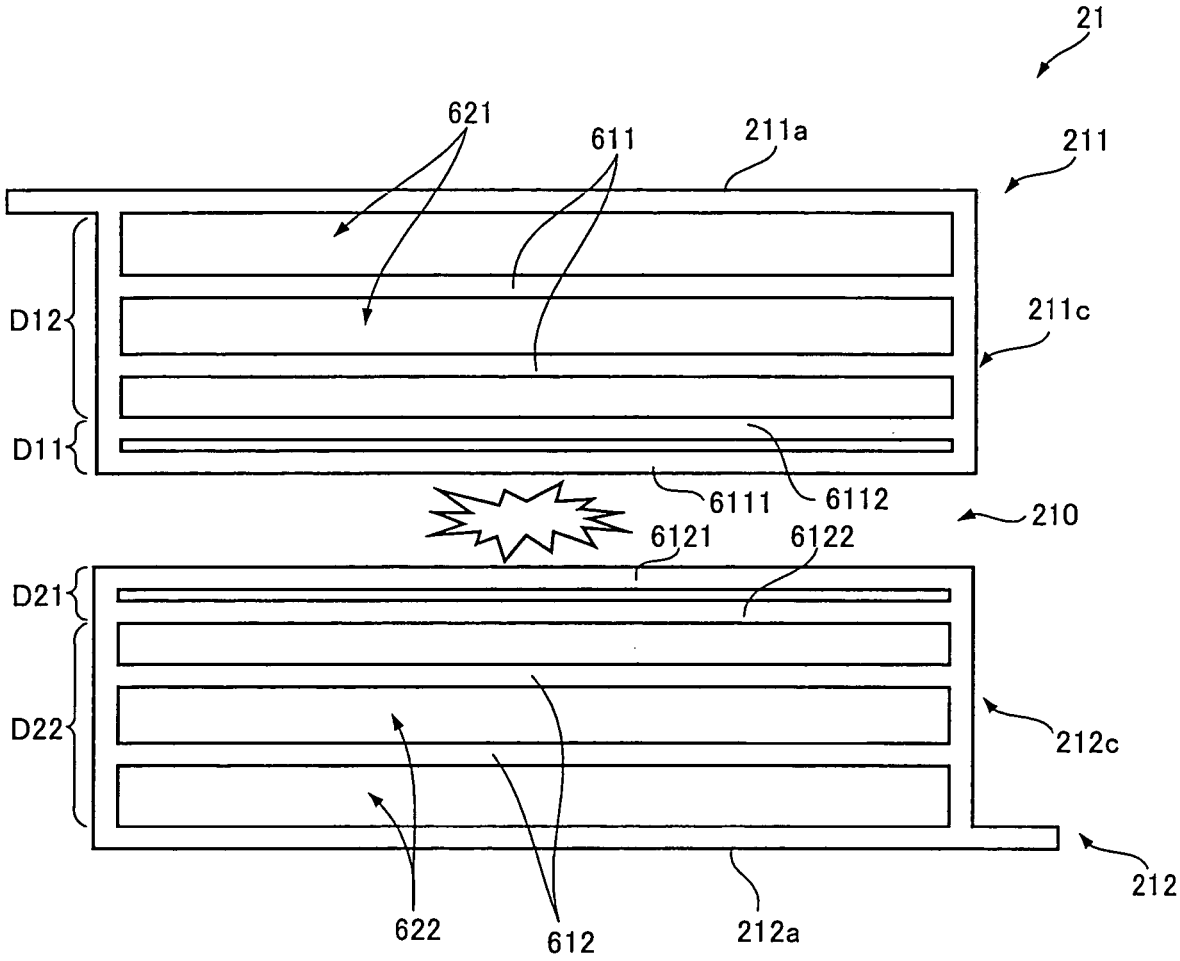
FIG. 8 illustrates display electrodes of a plasma tube array according to a third embodiment of the present invention.

FIG. 8 illustrates display electrodes of a plasma tube array according to a third embodiment of the present invention.

This FIG. 8 shows a display electrode pair 21 made up of two display electrodes 211, 212 between which a discharge slit 210 is interposed and the respective display electrodes 211, 212 are constructed of bus electrodes 211*a*, 212*a* and branched electrodes 211*c*, 212*c*.

The branched electrodes 211*c*, 212*c* in this FIG. 8 are formed of metal thin wires 611, 612 arranged parallel to the discharge slit 210 and slit-like openings 621, 622 are formed between these metal thin wires 611, 612. Here, all the metal thin wires 611, 612 making up the branched electrodes 211*c*, 212*c* have the same wire width. However, first regions D11, D21 enclosed by one metal thin wire 6111, 6121 facing the discharge slit 210 and neighboring metal thin wire 6112, 6122 have a narrower space so as to have a smaller opening ratio than that of second regions D12, D22 of the branched electrodes 211*c*, 212*c* other than the first regions D11, D21. The opening ratio here refers to the ratio of the area of the openings except the area covered with metal thin wires to the area of the region, and a higher opening ratio means a higher transmission coefficient of light from the light-emitting strings. Furthermore, instead of the opening ratio, a "coverage rate" representing the ratio of the area covered with metal thin wires represented by (1−opening ratio) may also be used below.

As shown in this FIG. 8, reducing only the opening ratio of the first regions D11, D21 in the vicinity of the discharge slit 210 also improves the discharge characteristic, eliminates the necessity for drastically reducing the overall opening ratio of the branched electrodes 211*c*, 212*c* and can balance the discharge characteristic and the opening ratio at a high level.

Figure 9A:
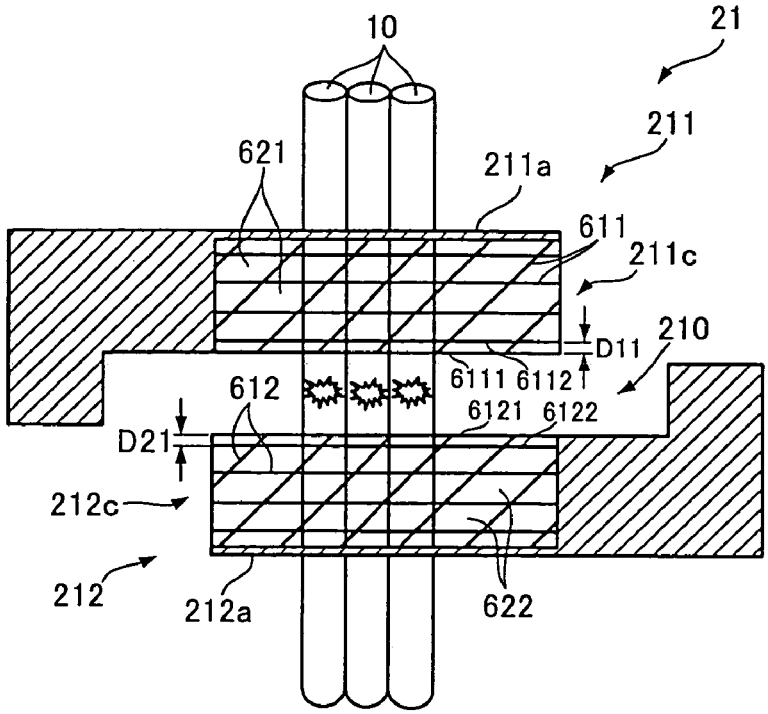
FIGS. 9(A) and 9(B) illustrate display electrodes of a plasma tube array according to a fourth embodiment of the present invention.
Figure 9B:
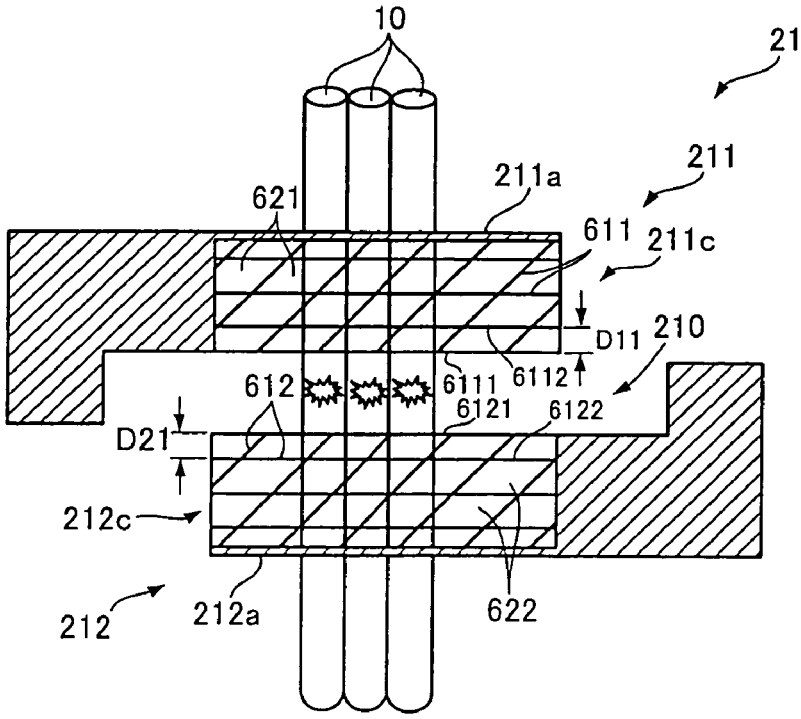

FIGS. 9(A) and 9(B) illustrate display electrodes of a plasma tube array according to a fourth embodiment of the present invention. FIGS. 9(A) and 9(B) show three light-emitting strings 10 respectively.

In these FIGS. 9(A) and 9(B), the same components as those of the display electrodes of the third embodiment shown in FIG. 8 are assigned the same reference numerals as those in FIG. 8.

FIGS. 9(A) and 9(B) as well as FIG. 8 show a display electrode pair 21 made up of two display electrodes 211, 212 between which a discharge slit 210 is interposed and the respective display electrodes 211, 212 are constructed of bus electrodes 211*a*, 212*a* and branched electrodes 211*c*, 212*c*.

The branched electrodes 211*c*, 212*c* in FIGS. 9(A) and 9(B) are formed of metal thin wires wired parallel to the discharge slit 210 and metal thin wires wired diagonal to the discharge slit 210 and rhombic openings 621, 622 are formed between their metal thin wires 611, 612. As with FIG. 8, the metal thin wires 611, 612 making up the branched electrodes 211*c*, 212*c* also have the same wire width here.

Here, in the case of the electrode structure shown in FIG. 9(A), the widths between metal thin wires 6111, 6121 and metal thin wires 6112, 6122 are set so that the coverage rate (1−opening ratio) of first regions D11, D21 (including their respective metal thin wires 6111, 6121; 6112, 6122) enclosed by the metal thin wires 6111, 6121 facing the discharge slit 210 and neighboring metal thin wires 6112, 6122 extending parallel thereto becomes 57%. In the case of FIG. 9(B), the coverage rate is set to 33% in the entire region of the branched electrodes 211*c*, 212*c* including the first regions D11, D21. In FIG. 9(A), the coverage rate of the branched electrodes 211*c*, 212*c* except the first regions D11, D21 is set to 33%, too.

Figure 10:
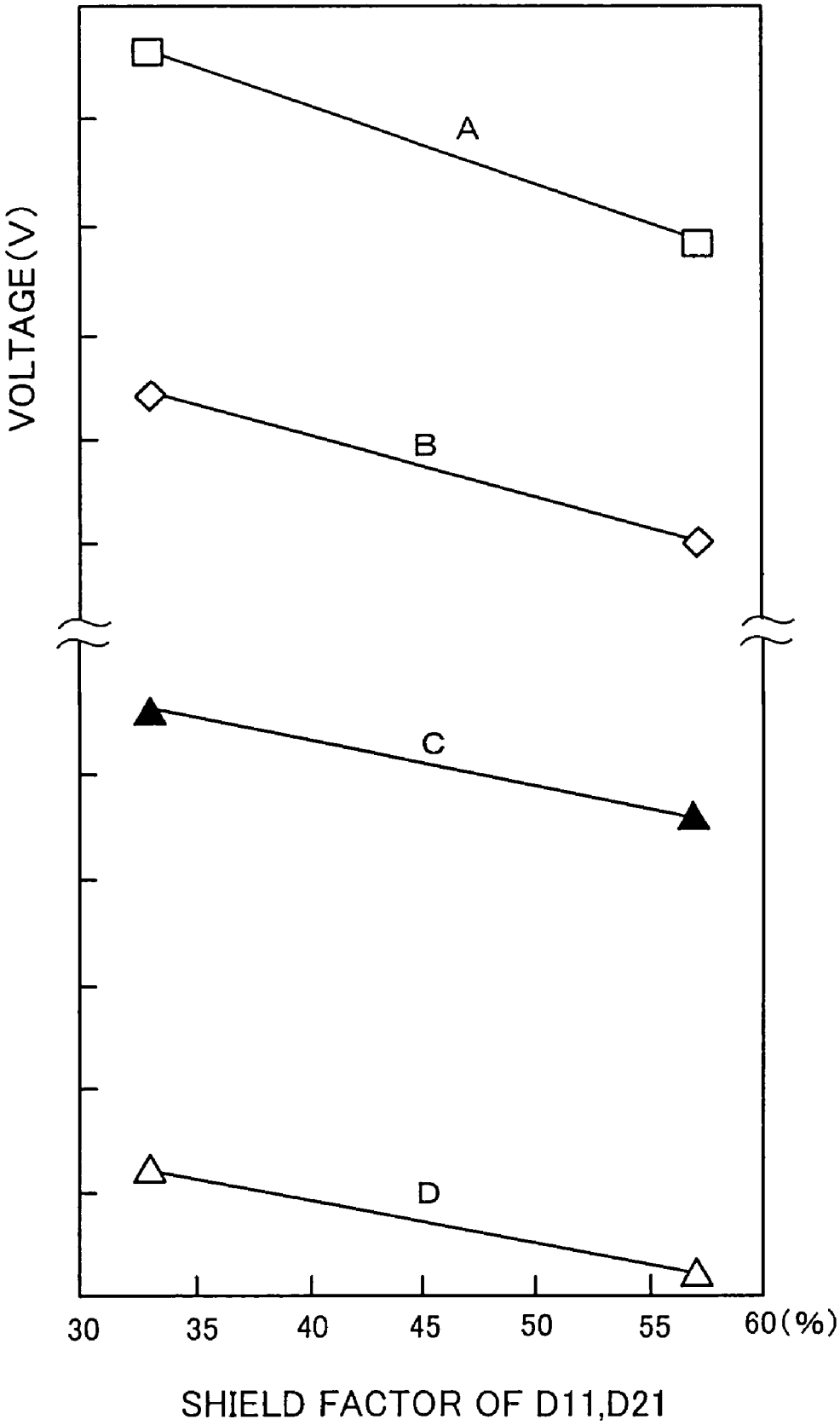
FIG. 10 illustrates a discharge characteristic of the electrode structure shown in FIGS. 9(A) and 9(B)

FIG. 10 illustrates the discharge characteristic of the electrode structure shown in FIGS. 9(A) and 9(B). This FIG. 10 as well as FIG. 7 shows a result of continuously applying a high-voltage square wave voltage to the display electrodes 211, 212, a so-called sustained drive. The horizontal axis shows a coverage rate (%) (1−opening ratio) of the regions D11, D21 and the vertical axis shows voltage (V) and graphs A, B, C, D represent last ON voltage A, first ON voltage B, first OFF voltage C and last OFF voltage D respectively as in the case of FIG. 7.

As is evident from this FIG. 10, the discharge characteristic is also improved by increasing only the coverage rate (reducing the opening ratio) of the regions D11, D21 in the vicinity of the discharge slit 210. That is, both the first ON voltage B and first OFF voltage C decrease, and therefore it is possible to reduce the drive voltage and increase the brightness of light emission when the same drive voltage is applied.

Figure 11:
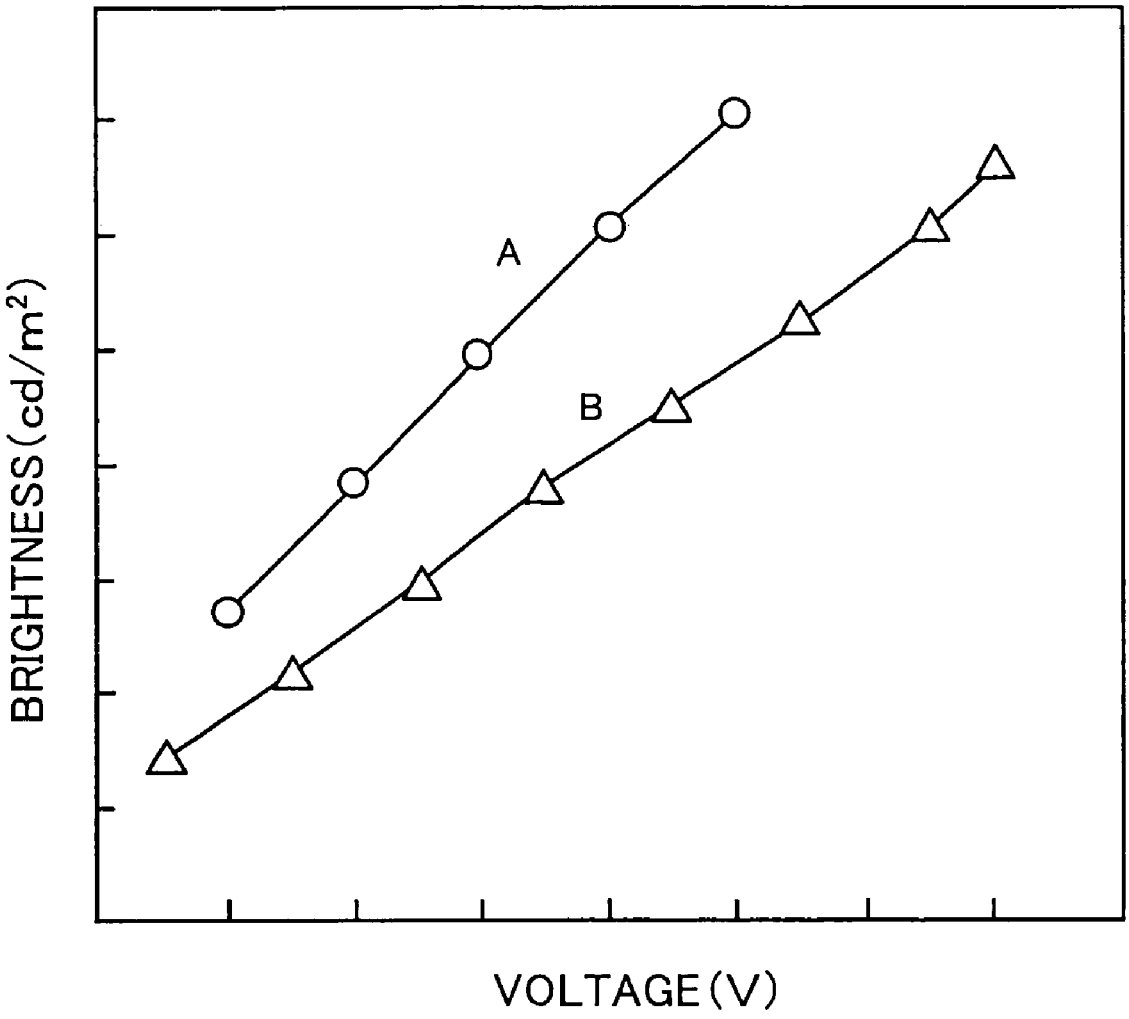
FIG. 11 illustrates a relationship between a drive voltage and brightness of light emission in the electrode structure in FIGS. 9(A) and 9(B)

FIG. 11 illustrates a relationship between a drive voltage (V) and brightness of light emission (cd/m$^2$) in the electrode structure in FIGS. 9(A) and 9(B).

As shown in FIG. 9(A), graph A corresponds to the case where the opening ratio of only the first regions D11, D21 adjacent to the discharge slit 210 is reduced (shield factor is reduced to 57%) and as shown in FIG. 9(B), graph B corresponds to the case where the opening ratio of the overall region of the branched electrodes 211*c*, 212*c* is the same (coverage rate is 33%).

In order to obtain the same brightness of light emission, the graph A when only the coverage rate in the vicinity of the discharge slit 210 is increased requires a lower drive voltage than the graph B when the coverage rate is uniform, and therefore the graph A can obtain higher brightness of light emission when driven at the same drive voltage.

Thus, as shown in FIG. 8 and FIG. 9(A), reducing the opening ratio (increasing the coverage rate) of the region in the vicinity of the discharge slit 210 improves the discharge characteristic, does not require the opening ratio to be reduced considerably for the entire region of the branched electrodes 211*c*, 212*c* and can thereby balance the discharge characteristic and opening ratio at a high dimension.

Figure 12:
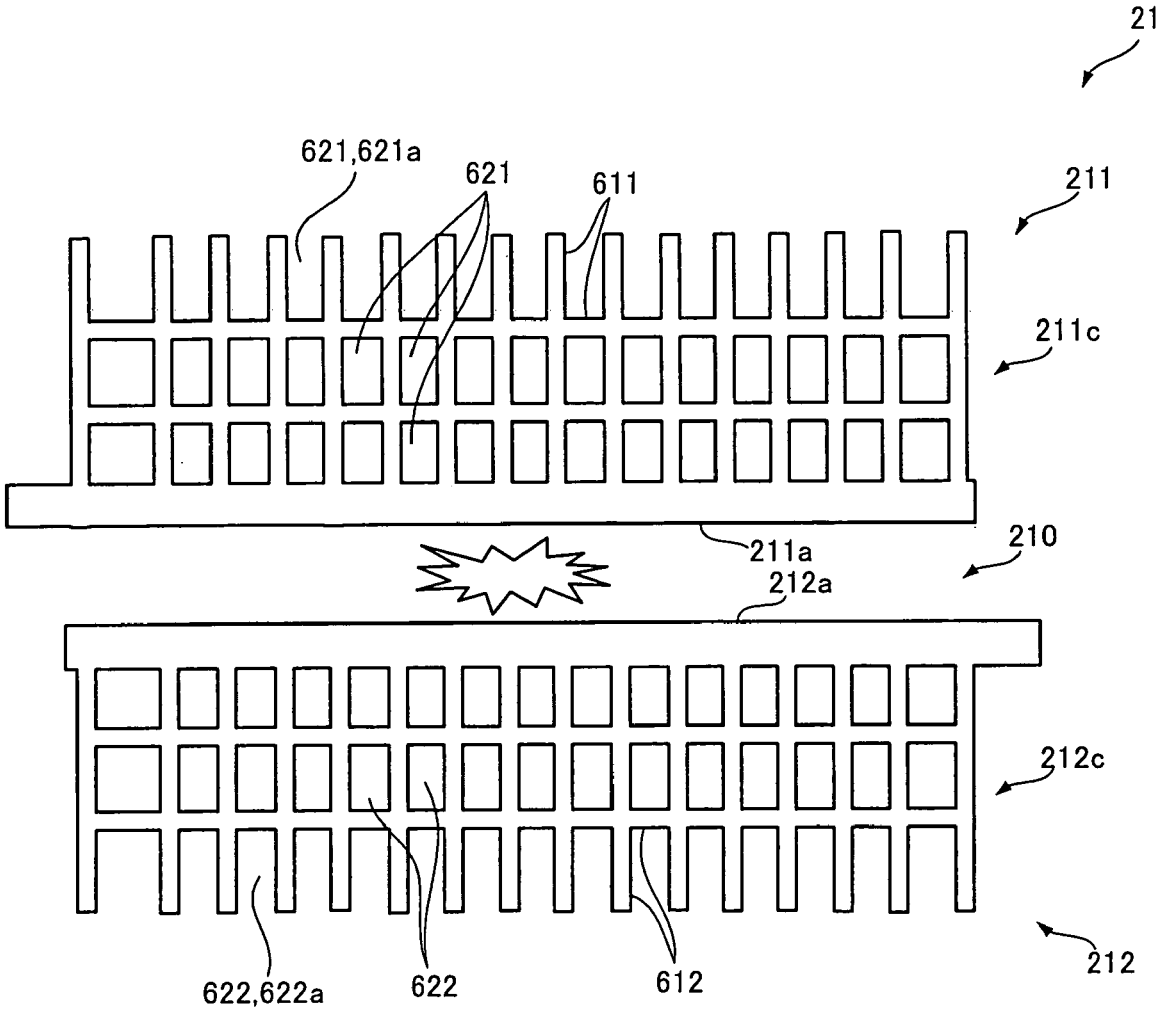
FIG. 12 illustrates display electrodes of a plasma tube array according to a fifth embodiment of the present invention.

FIG. 12 illustrates display electrodes of a plasma tube array according to a fifth embodiment of the present invention.

In this FIG. 12, bus electrodes 211*a*, 212*a* are formed at positions facing a discharge slit 210 and branched electrodes 211*c*, 212*c* are formed at positions farther from the discharge slit 210 (non-discharge slits formed between neighboring display electrode pairs (not shown)) than the bus electrodes 211*a*, 212*a*.

Furthermore, the branched electrodes 211*c*, 212*c* are formed of metal thin wires 611, 612 of the same wire width extending vertically and horizontally and rectangular openings 621, 622 are formed between the metal thin wires 611, 612. However, the sides farthest from the discharge slit 210, that is, openings 621*a*, 622*a* adjacent to the non-discharge slit have no metal thin wire which would partition the neighboring non-discharge slit and are open to the non-discharge slit.

In the case of the display electrodes having the electrode structure shown in this FIG. 12, the bus electrodes 211*a*, 212*a* are formed at positions adjacent to the discharge slit 210, which produces the same effect as that of the first embodiment shown in FIG. 5, that is, using a thick metal thin wire only for the metal thin wire adjacent to the discharge slit 210 produces the effect of improving the discharge characteristic. Furthermore, the absence of a metal thin wire extending laterally on the non-discharge slit side to be formed in spaces with the neighboring display electrode pairs can narrow the slit width of the non-discharge slit and expand the areas of the branched electrodes 211*c*, 212*c* accordingly to thereby balance the high opening ratio and the improvement of the discharge characteristic as a whole at a further higher level.

Figure 13:
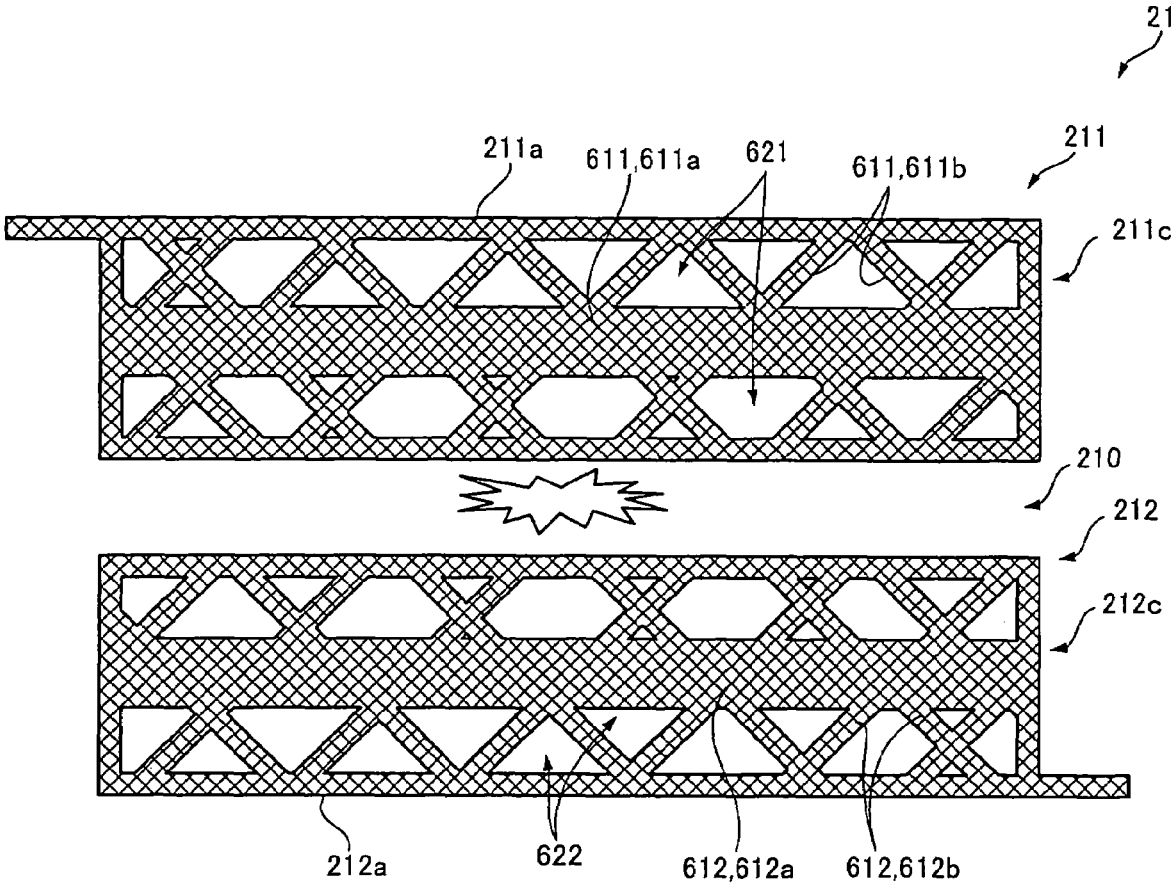
FIG. 13 illustrates display electrodes of a plasma tube array according to a sixth embodiment of the present invention.

FIG. 13 illustrates display electrodes of a plasma tube array according to a sixth embodiment of the present invention.

The figure shows a display electrode pair 21 made up of two display electrodes 211, 212 between which a discharge slit 210 is interposed and the respective display electrodes 211, 212 are constructed of bus electrodes 211*a*, 212*a* and branched electrodes 211*c*, 212*c* made up of mesh-like metal thin wires 611, 612. Multiple openings 621, 622 enclosed by the metal thin wires 611, 612 are formed over the entire surfaces of the branched electrodes 211*c*, 212*c*.

Here, the display electrodes 211, 212 shown in this FIG. 13 adopt thicker metal thin wires.

What is claimed is:

1. A plasma tube array comprising:

a plurality of light-emitting tubes arranged parallel to one another, each containing a fluorescent substance layer;

a front supporting member and a back supporting member which spread over the front and back of the plurality of light-emitting tubes;

a plurality of display electrode pairs provided on the surface of the front supporting member facing the light-emitting tubes, each made up of two display electrodes extending parallel to each other in a direction extending across the plurality of light-emitting tubes between which a predetermined discharge slit is interposed, with one display electrode pair neighboring the other with a non-discharge slit interposed in between; and a plurality of signal electrodes provided on the surface of the back supporting member facing the light-emitting tubes, formed associated with the plurality of light-emitting tubes, which extend along the light-emitting tubes, wherein at least one of the display electrodes constituting the display electrode pair has a plurality of openings and metal wires forming the openings have different widths depending on area.

2. The plasma tube array according to claim 1, wherein at least one of the display electrodes constituting the display electrode pair has a metal wire facing the discharge slit and extending along the discharge slit, the metal wire being larger in width than other metal wires.

3. The plasma tube array according to claim 1, wherein at least one of the display electrodes constituting the display electrode pair has a plurality of metal wires extending in a direction orthogonal to the light-emitting tubes, and the metal wires are substantially parallel to the other of the display electrodes constituting the pair.

4. The plasma tube array according to claim 2, wherein among the metal wires, a metal wire having the largest width is twice in width than a metal wire having the smallest width.

5. The plasma tube array according to claim 1, wherein at least one of the display electrodes constituting the display electrode pair has a first region facing the discharge slit, the first region having a smaller opening ratio than a second region disposed closer to the non-discharge slit than the first region.

6. The plasma tube array according to claim 5, wherein the opening ratio of the first region is 50% or less.

7. The plasma tube array according to claim 3, wherein at least one of the display electrodes constituting the display electrode pair has a plurality of metal wires extending in a direction orthogonal to the light-emitting tubes and forming openings.

8. The plasma tube array according to claim 1, wherein at least one of the display electrodes constituting the display electrode pair has a metal wire facing the non-discharge slit and extending along the non-discharge slit, the metal wire being larger in width than other metal wires.

9. The plasma tube array according to claim 1, wherein at least one of the display electrodes constituting the display electrode pair includes an opening adjacent to the non-discharge slit, which is open to the non-discharge slit.

10. The plasma tube array according to claim 1, wherein the display electrodes constituting the display electrode pair excluding extension lines thereof are shaped symmetrically.

11. The plasma tube array according to claim 2, wherein the display electrodes constituting the display electrode pair excluding extension lines thereof are shaped symmetrically.

12. The plasma tube array according to claim 3, wherein the display electrodes constituting the display electrode pair excluding extension lines thereof are shaped symmetrically.

13. The plasma tube array according to claim 4, wherein the display electrodes constituting the display electrode pair excluding extension lines thereof are shaped symmetrically.

14. The plasma tube array according to claim 5, wherein the display electrodes constituting the display electrode pair excluding extension lines thereof are shaped symmetrically.

15. The plasma tube array according to claim 6, wherein the display electrodes constituting the display electrode pair excluding extension lines thereof are shaped symmetrically.

16. The plasma tube array according to claim 7, wherein the display electrodes constituting the display electrode pair excluding extension lines thereof are shaped symmetrically.

17. The plasma tube array according to claim 8, wherein the display electrodes constituting the display electrode pair excluding extension lines thereof are shaped symmetrically.

18. The plasma tube array according to claim 9, wherein the display electrodes constituting the display electrode pair excluding extension lines thereof are shaped symmetrically.

* * * * *